US005252002A

United States Patent [19]

Day

[11] Patent Number: 5,252,002

[45] Date of Patent: Oct. 12, 1993

[54] NATURAL BOTTOM CULVERT AND METHOD FOR INSTALLATION

[76] Inventor: Jesse C. Day, Rte. 1 Box 846, Astoria, Oreg. 97103

[21] Appl. No.: 914,706

[22] Filed: Jul. 14, 1992

[51] Int. Cl.[5] ..... E01F 5/00

[52] U.S. Cl. ..... 405/126; 405/124; 405/150.1

[58] Field of Search ..... 405/124, 125, 126, 127, 405/137, 149, 150.1; 14/24; 52/86

[56] References Cited

U.S. PATENT DOCUMENTS

| | | | |
|---|---|---|---|
| 597,590 | 1/1898 | Pratt . | |
| 678,605 | 7/1901 | Wolcott et al. . | |
| 832,017 | 9/1906 | Hummel | 405/126 |
| 1,071,185 | 8/1913 | Shannon . | |
| 1,955,407 | 4/1934 | Carswell et al. . | |
| 1,964,313 | 6/1934 | Carswell et al. | 405/125 |
| 2,126,091 | 8/1938 | Claybaugh | 405/124 |
| 2,736,334 | 2/1956 | Riley et al. . | |
| 2,894,527 | 7/1959 | Riley . | |
| 3,768,108 | 10/1973 | Wadsworth . | |
| 4,211,504 | 7/1980 | Sivachenko . | |
| 4,558,969 | 12/1985 | FitzSimons . | |
| 4,563,107 | 1/1986 | Peterson . | |
| 4,839,935 | 6/1989 | Calcagni et al. . | |
| 4,983,070 | 1/1991 | Hwang . | |

FOREIGN PATENT DOCUMENTS 3904519A 8/1990 Fed. Rep. of Germany .

*Primary Examiner*—David H. Corbin

*Attorney, Agent, or Firm*—William A. Birdwell & Associates

[57] ABSTRACT

A natural bottom culvert and installation method that preserves the in-stream environment for fish to spawn, forage and migrate, while being able to withstand high-water levels. The culvert has an arch-shaped member that is placed over the stream in connection with elongate footings placed on terraces prepared on each stream bank. The footings have a plurality of apertures spaced along their elongate dimensions. Anchor posts are driven into the terraces through the apertures and affixed to the footings. Fill material is placed over this assembly and a road is constructed over the fill material.

24 Claims, 9 Drawing Sheets

NATURAL BOTTOM CULVERT AND METHOD FOR INSTALLATION

BACKGROUND OF THE INVENTION

This invention relates to stream crossing structures, particularly natural bottom culverts and installation methods therefor that preserve the in-stream environment for fish to spawn, forage and migrate and that can withstand high water levels.

Roads are frequently constructed adjacent streams and, consequently, traversing the streams and their feeder streams often is necessary. This is particularly so in constructing logging roads in mountainous forest terrain. Prior to 1940, streams generally were crossed using either trestle bridges or puncheons (sometimes referred to as "Humboldt crossings"). While trestles were built above and across the streams, puncheons were constructed in the stream by laying large logs side-by-side longitudinally along the streambed, then laying additional logs across the stream transversing the first layer of logs and, finally, backfilling soil on top of the second layer to form the roadbed. So constructed, puncheons not only disturb the stream environment, but also have been subject to catastrophic failure. Nevertheless, puncheons allow fish to migrate because the bottom layer logs are spaced apart.

By the late 1940's, culverts were being widely used in place of puncheons to cross streams. Conventional culverts generally include round pipes or pipe arches with integral, solid bottoms. Culverts of this type are described, for example, in Shannon U.S. Pat. No. 1,071,185, Sivachenko U.S. Pat. No. 4,211,504, Peterson U.S. Pat. No. 4,563,107and Hwang U.S. Pat. No. 4,983,070. The artificial bottoms of such culverts impede the migration and spawning of fish, insects and crustaceans through the culvert because such culverts tend to move water at velocities above those natural to the stream while providing no place for the fish, insects and crustaceans to rest. Spawning, migration and foraging are further impeded because fish able to enter the culvert's exit cannot leave its upstream entrance if any impediment such as rocks, soil or other debris, is washed into that entrance. Moreover, damage results from water exiting the culvert at an elevated velocity, causing accelerated erosion of the soil and rock. While some conventional culverts are open at the bottom so as not to cover the entire natural streambed, as shown by Wolcott et al. U.S. Pat. No. 678,605, Pratt U.S. Pat. No. 597,590 and FitzSimons U.S. Pat. No. 4,558,969, their foundations tend to be undermined by the water. While attempts have been made to construct a culvert whose position cannot be changed by the water rushing through the culvert, this typically has resulted in a structure that necessarily disturbs the natural streambed as, for example, in Carswell et al. U.S. Pat. No. 1,955,407. Such structures tend to produce unnatural erosion of the streambed as well as corrosion caused by trapped debris.

Because both puncheons and conventional culverts have inherent shortcomings, a need exists for an improved stream crossing structure.

SUMMARY OF THE INVENTION

The present invention fulfills the aforementioned need by providing a natural bottom culvert that overcomes the shortcomings of prior art stream crossing structures and provides certain advantages not heretofore available in stream crossing structures. Specifically, the natural bottom culvert of the present invention preserves the in-stream environment for fish to spawn, forage and migrate, while being able to withstand high-water levels. Because the bottom of the culvert of the present invention is the streambed itself, water passes through the culvert at natural velocity, thereby avoiding the accelerated streambed erosion caused by the solid bottoms of conventional culverts. Moreover, because the streambed is undisturbed, fish, fish smelts, insects and crustaceans are able to migrate through the culvert without impediment.

Broad, generally flat footings provided by the invention prevent backfill from rotating thereunder into the stream where undermining of the footings occurs. They also keep the backfill in place when the culvert is subjected to heavy loads. Thence, the culvert of the present invention is not subject to catastrophic failure.

In a basic embodiment of the invention, the natural bottom culvert comprises an arch structure affixed to two L-shaped footings that are placed on terraces prepared on the stream banks. The terraces are at a distance from the respective stream edge which is determined both to provide structural integrity and to minimize disturbance to the in-stream environment. Each L-shaped footing has a baseplate that lies on the prepared terrace with its long axis substantially co-directional with the stream, and has an upwardly-directed wall disposed slightly offset from, but adjacent and substantially along the full length of, the stream-side edge of the baseplate. Each footing preferably has tubular guides affixed at substantially regular intervals both to the baseplate and to the surface of the wall away from the stream, and has apertures in the baseplate aligned with the tubular guides so that anchor posts may be driven therethrough into the terrace. The arch structure is seated on the baseplate in contact with the stream-side surface of the wall and is affixed to the wall. The anchor posts are affixed to the footings, so that the footings will remain in place during high-water conditions. Fill material is placed over this assembly of arch, footings and posts, and a road is constructed over the fill material.

In another type of footing, the upwardly-directed wall and tubular guides are replaced by an H-shaped beam. The H-shaped beam is disposed slightly offset from, but adjacent and substantially along the full length of the baseplate's stream-side edge with the beam's two legs in contact with, and upwardly directed from, the baseplate. The H-shaped beam is affixed to the baseplate where the beam's legs contact the baseplate. In addition, on either side of the beam, a piece of 90-degree angle steel is affixed both to the beam's leg and to the baseplate. The H-shaped beam has guides in its cross-member which are disposed along the beam's length at regularly spaced intervals and are aligned with apertures in the baseplate so that anchor posts may be driven therethrough into the terrace. The arch structure is seated on the baseplate in contact with, and affixed to, the stream-side leg of the H-shaped beam. The anchor posts are then affixed to the H-shaped beam.

One type of arch structure employed in the basic embodiment of the present invention is a pipe arch comprising half of a corrugated round pipe. Another type of arch structure comprises a pair of evenly-spaced, arch-shaped plates, separated by a core material, and held together at each end by an I-shaped beam. Deflection and collapse of the alternative arch structure, referred to herein as a composite arch, is resisted in part by a plurality of tension cables strung across the bottom of the arch, attached at regular intervals along the length of the I-shaped beams and substantially in the middle of the beams' vertical members. The composite arch preferably is affixed to the footings by welding pieces of 90-degree angle steel to the top and bottom members of the I-beams and bolting the pieces of angle steel to the footings.

In one alternative embodiment of the natural bottom culvert, the culvert comprises an arch structure having guide holes affixed to L-shaped footings. The L-shaped footings, unlike the footings of the basic embodiment, have no tubular guides. Each footing's baseplate has apertures that are aligned with the guide holes of the arch structure so that anchor posts may be driven therethrough into the terrace. The arch structure is seated over the wall of each footing so that the underside of the arch is in contact with a platform made by bending the top of that wall. So seated, the ends of the arch structure are in contact with the baseplates of the footings. The arch structure is affixed to the footings where it contacts the walls and the baseplates.

In a second alternative embodiment of the natural bottom culvert of the present invention, a single metal plate is bent to form an arch portion between, and integral with, two footing portions. Each footing portion has apertures at substantially regular intervals along its length, disposed adjacent to the edge of the footing portion away from the stream, so that anchor posts may be driven therethrough into the terrace. The anchor posts are affixed to the footing portions.

The natural bottom culvert of the present invention generally is designed for crossing streams that require culverts with diameters greater than 2 feet and that do not require bridges with spans over 30 feet. However, the second alternative embodiment comprising a single bent metal plate is designed for streams that require culvert diameters of 2 feet or less.

The natural bottom culvert of the present invention can be installed over streams with high gradients that would require baffles and fish ladders. The culvert also can be installed under fill in excess of 30 feet in depth and length-to-length for wider crossings.

Accordingly, a principal object of the present invention is to provide a novel and improved stream crossing structure and installation method in the nature of a culvert.

Another object of the present invention is to provide a culvert which does not disturb the natural streambed and thereby preserves the in-stream environment for fish to spawn, forage and migrate.

A further object of the present invention is to provide a culvert that passes water therethrough at the stream's natural velocity.

Yet another object of the present invention is to provide a culvert that is able to withstand high-water levels.

Yet a further object of the present invention is to provide a culvert that has long life and is not subject to catastrophic failure.

Another object of the present invention is to provide a culvert that can cross streams other than those requiring bridges with spans over 30 feet and that can be installed under fill depths in excess of 30 feet, as well as length-to-length for wider crossings.

A further object of the present invention is to provide a method for installing a natural-bottom culvert without disturbing the natural streambed over which it is installed.

The foregoing and other objects, features and advantages of the invention will be more readily understood upon consideration of the following detailed description of the invention, taken in conjunction with the accompanying drawings.

BRIEF DESCRIPTION OF THE DRAWINGS

FIG. 8(*b*) shows a cross section of a stream and streambed, and stream banks that have been terraced and on which footings incorporating H-beams and anchor posts have been installed according to the present invention.

FIG. 8(*c*) shows in a cross section of a stream and streambed, and a natural bottom culvert having a composite arch affixed to footings installed over the stream according to the present invention.

DETAILED DESCRIPTION OF THE INVENTION

Figure 1:
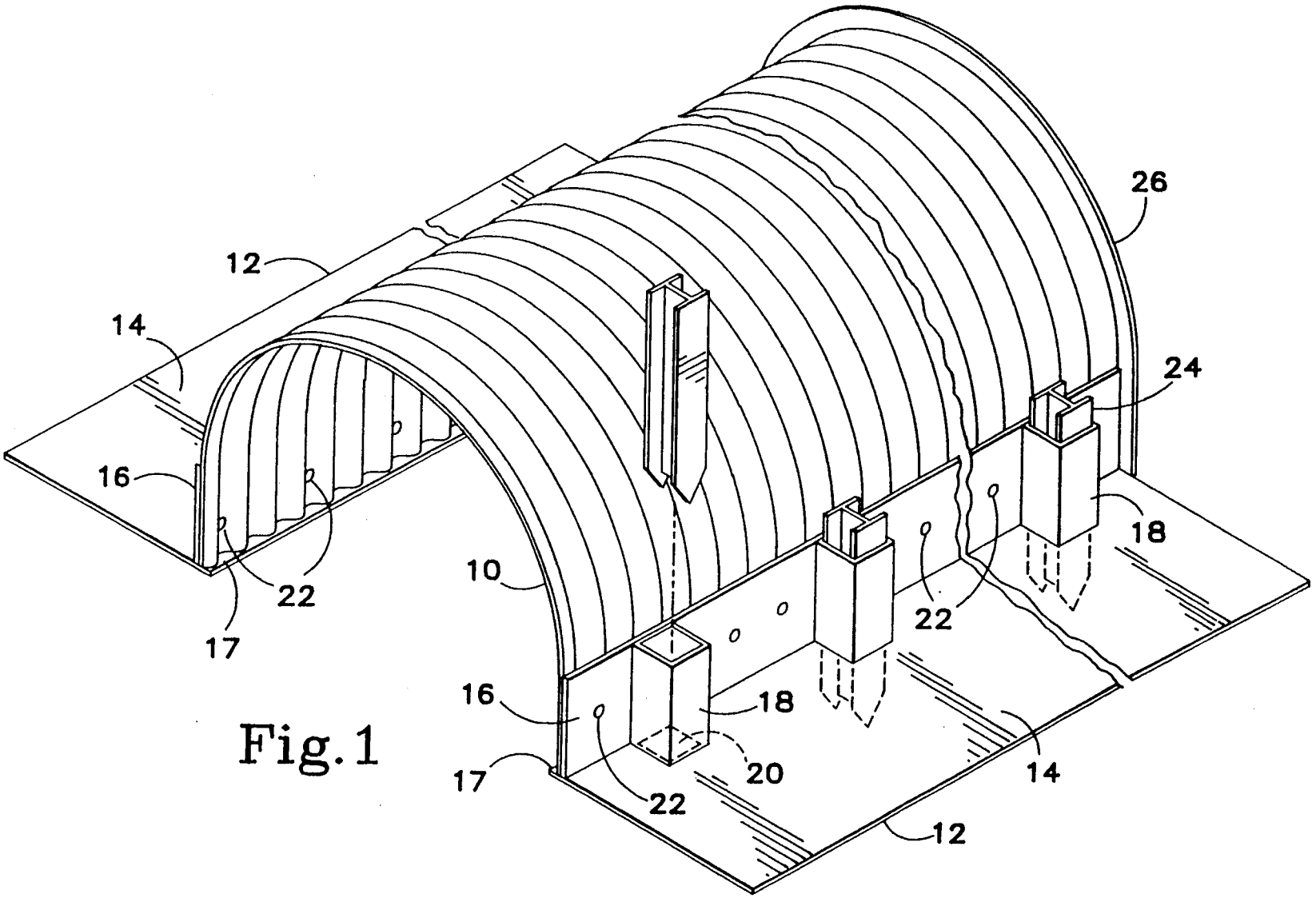
FIG. 1 is a perspective view of a basic embodiment of a natural bottom culvert according to the present invention.
Figure 2:
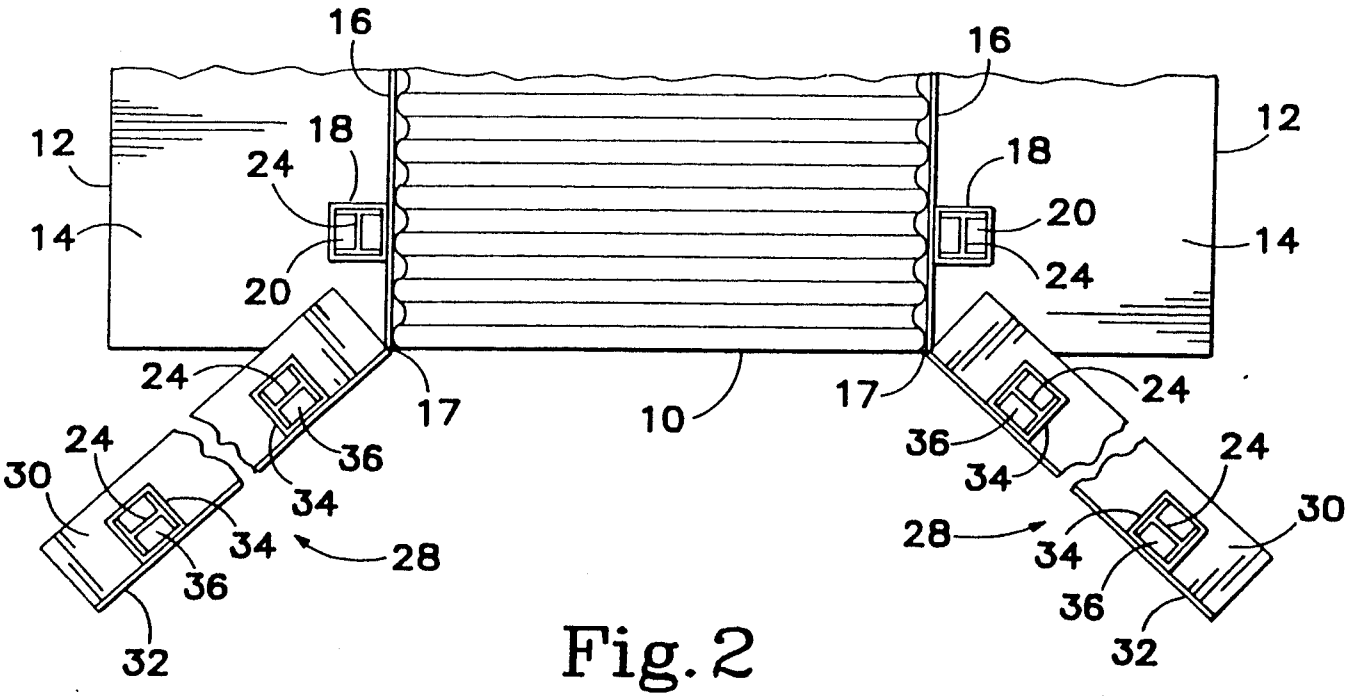
FIG. 2 is a top, cut-away view of the natural bottom culvert of FIG. 1 with wing walls attached.

A basic embodiment of the natural bottom culvert in accordance with the present invention is shown in FIGS. 1 and 2. The natural bottom culvert has an arch-shaped member, or arch structure, 10 affixed to footings 12. The arch structure 10 preferably is a standard pipe arch, that is, half of a metal pipe, which is corrugated and coated to resist deterioration.

Each footing 12 has a substantially L-shaped cross-section comprising a horizontally-directed baseplate 14 and an upwardly-directed wall 16. Each baseplate 14 is substantially planar and rectangular, and lies on a terraced portion of the bank of the stream to be crossed, with the baseplate's longitudinal axis substantially co-directional with the stream. The baseplates 14 may be a solid metal plate, preferably coated to resist deterioration. Alternatively, the baseplates 14 may be rigid metal mesh or perforated metal plate, that resists deterioration not only by being coated but also by allowing water and other corrosive liquids to pass therethrough.

Each wall 16 is substantially vertical, disposed adjacent and substantially along the full length of, the stream-side, or interiors, edge of the baseplate 14. So disposed on the baseplate 14, the wall 16 forms a lip 17 that substantially corresponds in width to the thickness of the arch structure 10 or, when corrugated, to the depth of the corrugations of the arch structure 10. Each footing 12 also has a plurality of tubular guides 18 that are preferably square in shape and welded at substantially regular intervals both to the baseplate 14 and to the bank-side surface of the wall 16. A corresponding plurality of apertures 20 are formed in the baseplate 14 and are aligned with the tubular guides 18.

The arch structure 10 preferably is affixed to the footings 12 by seating it on the lip 17 in contact with the stream-side surface of the wall 16 and then either welding or bolting it to each wall 16 at connection points 22 spaced along the length of the walls 16. Alternatively, the arch structure 10 may be affixed to the footings 12 by welding flanges (not shown) to each of the ends of the arch structure 10 and to the tops of each wall 16 and then welding or bolting together the corresponding arch and wall flanges. Other methods may also be used to affix the arch structure 10 to the footings 12, as desired, without departing from the principles of the invention.

A plurality of anchor posts 24 are driven into the terraced stream banks through each aligned pair of tubular guides 18 and apertures 20 of the footings 12. Once installed, the anchor posts 24 are affixed to the footings 12 by either welding or bolting, so that the footings 12 will remain in place should high-water conditions undermine the footings 12. However, due to the manner in which the natural bottom culvert of the present invention is installed, which preserves the natural streambed and banks, as explained below, undermining of the footings is less likely to occur than with conventional culverts. Nevertheless, when undermining does occur, the anchor posts 24 hold the culvert in place so that the concrete, rock or other support material may be inserted under the footing to restore its full competence.

Over this assembly of arch structure 10, footings 12 and anchor posts 22, fill material is placed, on the surface of which a road is constructed. The fill material is prevented from leaking into the stream through the corrugation openings of corrugated arch structures 10 because the openings are sealed by the lips 17 or, if flanges are used in affixing the arch structure 10 to the footings 12, by the width of the flanges.

The arch structure 10 can be fitted on its up and down stream edges with collars 26 in order to attach one assembly of arch structure 10, footings 12 and anchor posts 24 to one or more additional assemblies of such elements. The standard pipe arch, which is preferably used as the arch structure 10, is generally available in lengths of 20 feet. Accordingly, when constructing stream crossings of widths exceeding that 20-foot length, attaching one or more assemblies using collars 26 becomes desirable.

Referring to FIG. 2, a top, cut-away view of the natural bottom culvert of FIG. 1 is shown with wing walls 28 attached. The wing walls 28 comprise baseplates 30, walls 32, and a plurality of tubular guides 34, having respective of apertures 36, in a structure and assembly similar to the footings 12. As with the footings 12, a plurality of additional anchor posts 24 are driven into the stream banks through both the aligned pairs of tubular guides 34 and the apertures 36 of the wing walls 28, and the anchor posts 24 are affixed to the wing walls 28 by either welding or bolting. One end of each wing wall 28 is affixed to one of the footings 12 at the longitudinal end of the wall 16 and the baseplate 14 of the footing 12 by welding or bolting. The walls 32 of the wing walls 28 preferably are at least twice the height of the walls 16 of the footings 12 and preferably are constructed in ten foot lengths. The baseplates 30 preferably are less than one-half the horizontal width of the baseplates 14 of the footings 12. The wing walls 28 are used as the exposed, upstream edge of the natural bottom culvert, resisting the undermining of the footings 12 by high-water levels.

Figure 3:
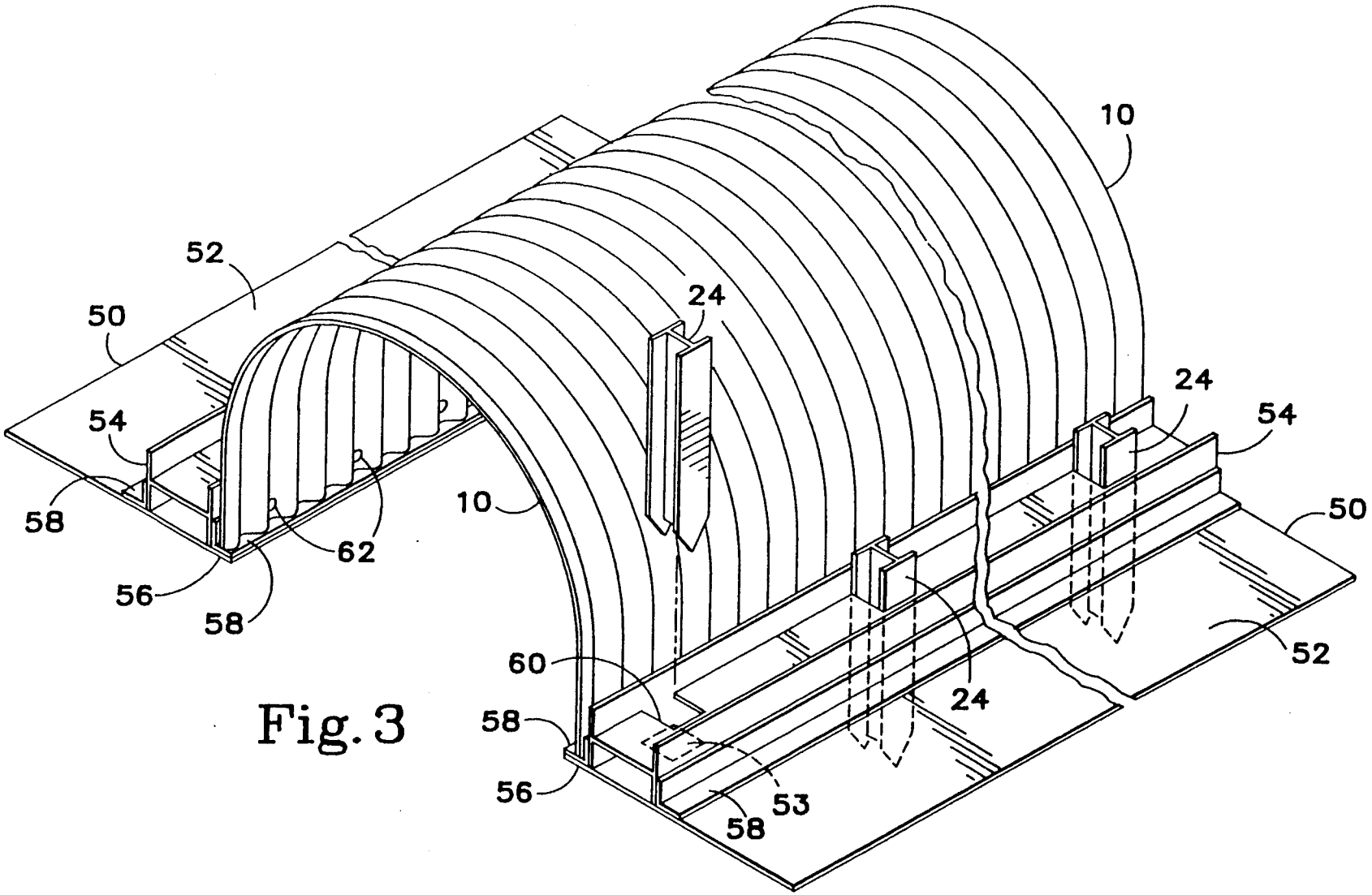
FIG. 3 is a perspective view of an alternative embodiment to the natural bottom culvert according to the present invention, including footings using H-shaped beams.

Referring to FIG. 3, an alternative embodiment of the natural bottom culvert of the present invention is shown that includes footings 50 which incorporate H-shaped beams 54. As with the footings 12 of FIG. 1, each footing 50 has a substantially planar, rectangular baseplate 52 that lies on a terraced portion of the bank of the stream to be crossed with the baseplate's long axis substantially co-directional with the stream. Each footing 50 has a plurality of apertures 53 in the baseplate 52, like the footings 12 of FIG. 1. Unlike the footings 12 of FIG. 1, each footing 50 has a beam 54 of H-shaped cross-section that replaces the upwardly-directed walls 16 and the tubular guides 18 of the footings 12. Each beam 54 is disposed adjacent and substantially along the full length of the stream-side edge of baseplate 52 with the two legs of the beam 54 in contact with, and upwardly-directed from, the baseplate 52. So disposed on the baseplate 52, the beam 54 forms a lip 56 that substantially corresponds in width to the thickness of the arch structure 10 or, when corrugated, to the depth of the corrugations of the arch structure 10. The beam 54 is affixed to the baseplate 52 by welding where the beam's legs contact the baseplate 52. In addition, on either side of the beam 54, a piece of 90-degree angle steel 58 is welded both to the baseplate 52 and to the corresponding leg of the beam 54. The pieces of angle steel 58 preferably are substantially the same length as the beam 54 and the baseplate 52.

Each beam 54 has a plurality of guides 60 formed as apertures through the cross-member of the beam 54 along the length thereof. The guides 60 preferably are disposed at regularly spaced intervals along that length, and are flush to the junction of the cross-member with the stream-side leg of the beam 54. The guides 60 preferably cut approximately half-way across the width of the cross-member. The guides 60 are aligned with corresponding apertures 53 through the baseplate 52.

The arch structure 10 preferably is seated on the footings 50 with its ends on the pieces of angle steel 58 that are welded on the lips 56. So seated, the arch structure 10 is in contact with the stream-side leg of the beam 54 and is affixed to the footings 50 by either welding or bolting to that leg at a plurality of connection points 62 spaced along the length of the beam 54.

A plurality of anchor posts 24 are driven into the terraced stream banks through each aligned pair of baseplate apertures 53 and beam guides 60. Once installed, the anchor posts 24 are affixed to the footings 50 by either welding or bolting the posts 24 to the beams 54. Over this assembly, as described above, fill material is placed, on the surface of which a road is constructed.

Figure 4:
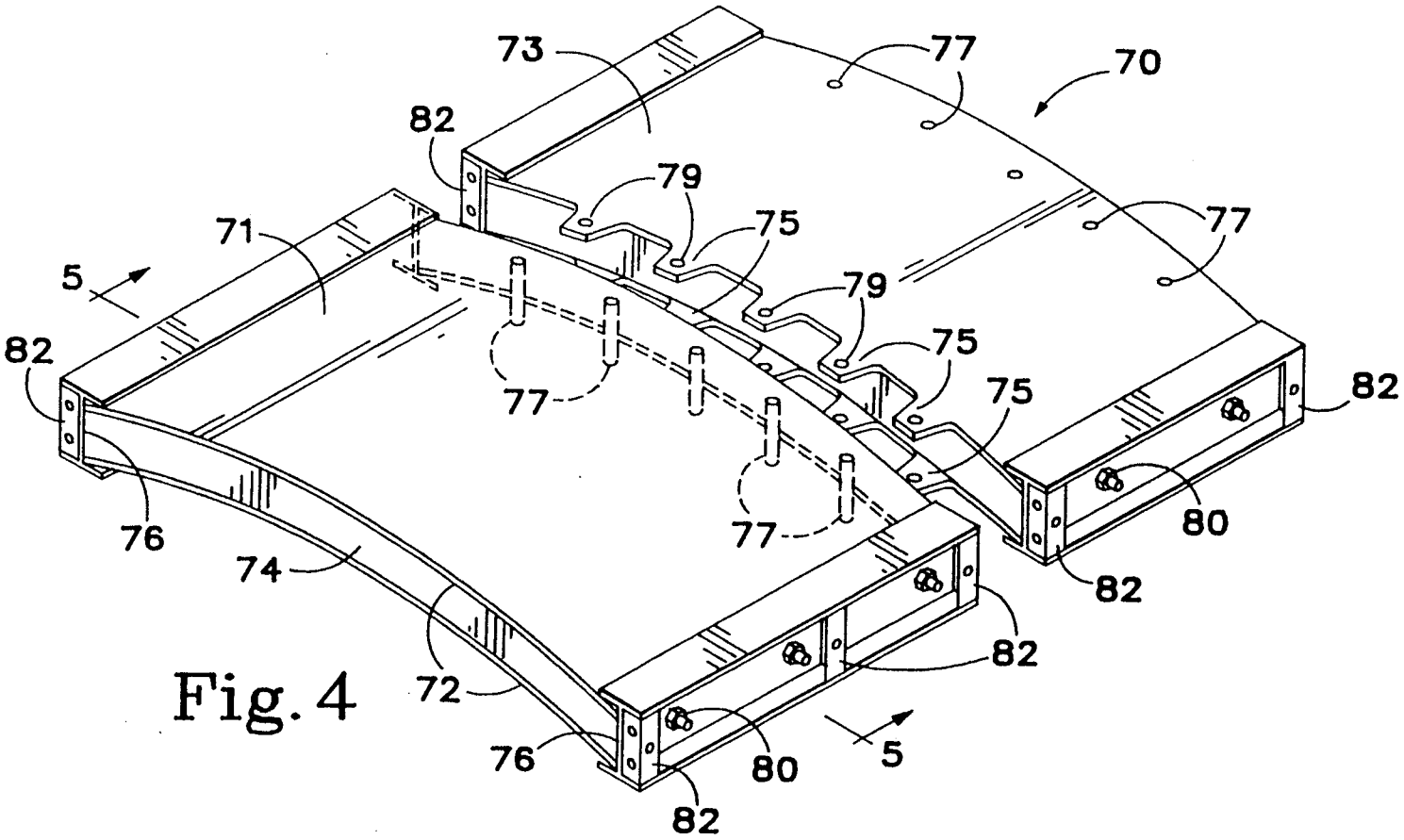
FIG. 4 is a perspective view of an alternative, composite arch structure for use in a natural bottom culvert according to the present invention.
Figure 5:
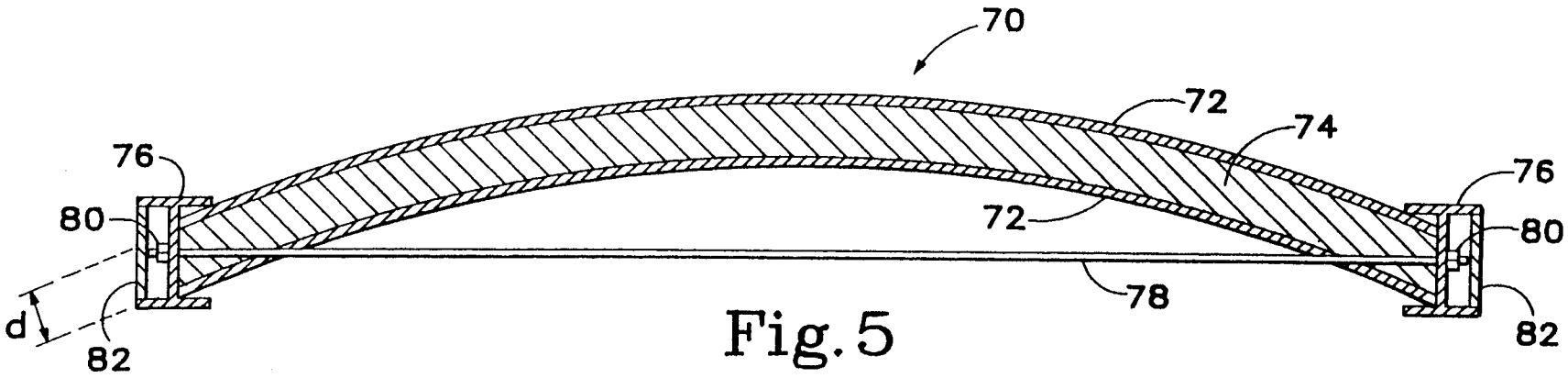
FIG. 5 is a cross-section of the composite arch of FIG. 4 taken along line 5—5 thereof.
Figure 8A:
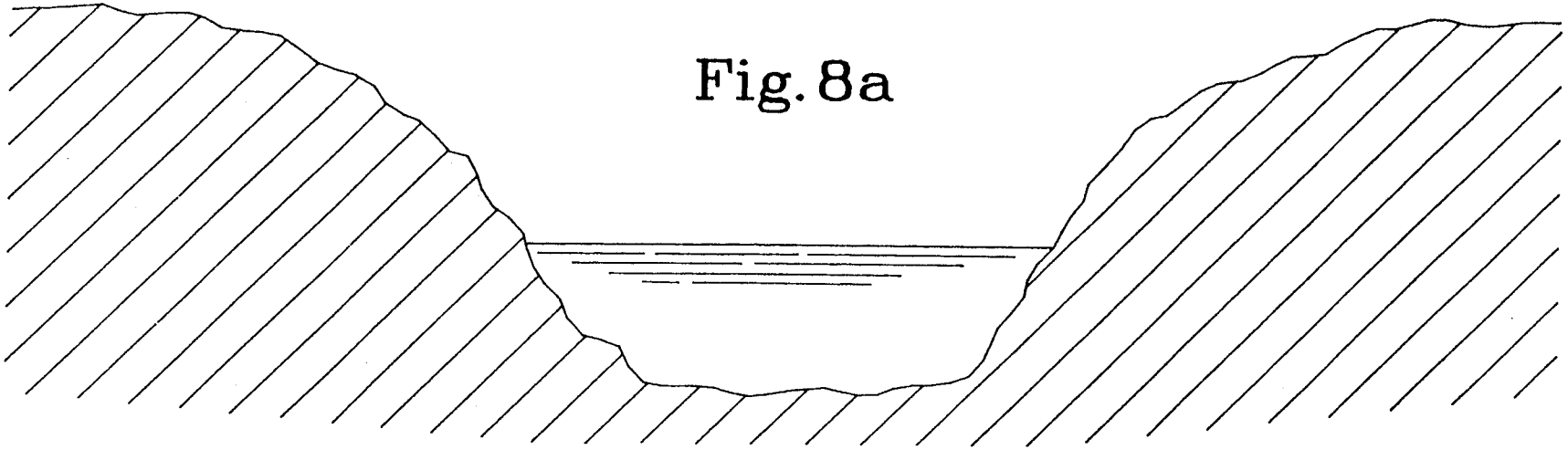
FIG. 8(*a*) shows a cross section of a stream, a streambed and stream banks prior to installation of a natural bottom culvert according to the present invention.
Figure 8B:
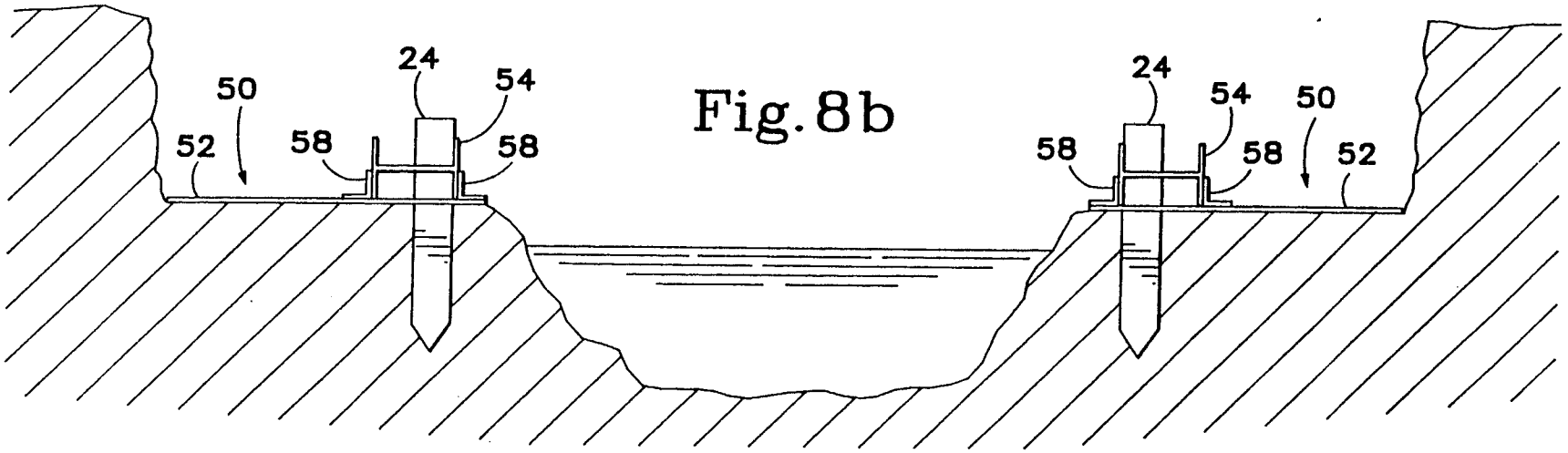
Figure 8C:
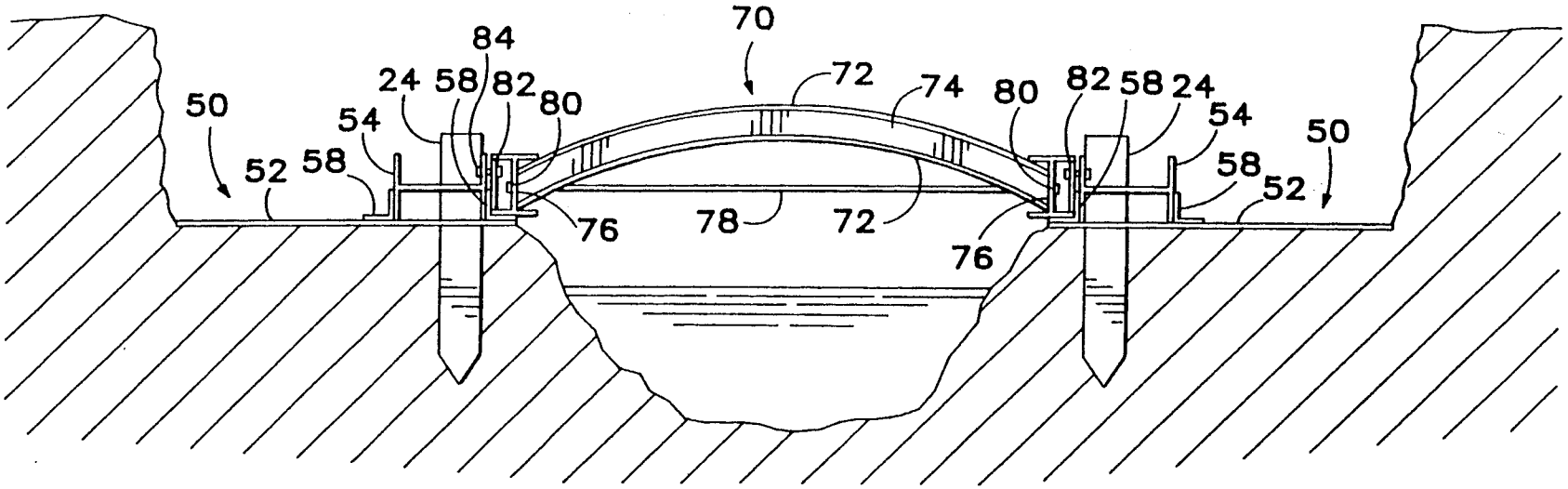

A composite arch 70, an alternative embodiment of the arch-shaped member, that is, arch structure 10 of FIG. 1, is shown in FIGS. 4, 5 and 8(*c*). The composite arch 70 comprises a pair of metal plates 72 that have arch-shaped cross-sections and that are disposed at a substantially constant distance from each other. The metal plates 72 are separated by a core material 74, preferably of high-density polyurethane foam, and are held together at each end by beams 76 having I-shaped cross-sections. The top and bottom members of the I-beam are disposed above and below the two metal plates 72, respectively, to hold them together. The composite arch's metal plates 72 preferably are sections of large radius, steel arch plate. Although the arch plate may be corrugated, it is to be recognized that other forms of plate may be used without departing from the principles of the invention.

The composite arch 70 has a plurality of tension cables 78 that are disposed across the bottom of the arch 70, through the lower of the metal plates 72 for attachment to the I-shaped beams 76 using a plurality of respective bolts 80. The cables 78 preferably are attached at regular intervals along the length of the I-shaped beams 76 and substantially in the middle of the beams' vertical members. The tension cables 78 assist the composite arch 70 in resisting separation of the I-beams, and deflection and collapse of the arch structures. Additional strength can be introduced by installing webbing (not shown) at regularly spaced intervals to and between each of the metal plates 72 so that the foam core 74 permeates the webbing. The webbing is attached to each metal plate 72 by epoxy or some other appropriate method. Preferably, the webbing is made of high-density, recycled plastic.

The composite arch 70 preferably is affixed to footings by welding pieces of 90-degree angle steel 82 to the top and bottom members of the I-shaped beams 76 and bolting the pieces of angle steel 82 to the footings using bolts 84. The composite arch 70 may be used with either the footing 12 shown in FIGS. 1 and 2 or the footing 50 shown in FIG. 3. Referring to FIG. 8(*c*), the composite arch 70 is shown installed using footing 50 shown in FIG. 3. Because bolts 84 are attached to angle steel 82 and to one leg of beam 54 and a space exists between the angle steel 82 and leg, preferably, a spacer (not shown) is used to fill that space.

The composite arch 70 preferably is constructed from arch modules 71 and 73 that are fabricated remotely from the stream site. The modules 71 and 73 are fabricated in various standard lengths so that modules of selected lengths may be attached length-to-length to construct the installed arch. It is anticipated that the maximum length of the arch modules 71 and 73 is 10 feet, due to constraints imposed by the highway system. In order to attach arch modules 71 and 73, at least one of the modules, for example module 73, preferably has aligned pairs of top and bottom tabs 75 along a side thereof and the other module, that is, module 71, has apertures 77 along a side thereof. Tabs 75 extend away from and in the same surfaces as respective upper and lower metal plates 72 of the module and have holes 79 therein. Apertures 77 extend through the metal plates 72 and the foam core 74 of the other module. Tab 75 and aperture 77 are disposed at common, regular intervals along the respective sides of the modules so that, in installation, modules 71 and 73 may be abutted to align the pairs of tabs 75 with an aperture 77. So installed, the modules 71 and 73 are attached by fixing a bolt or rivet through holes 79 of each respective pair of tabs 75 and apertures 77. If more than two arch modules 71 are attached, modules disposed between two other modules may be provided with tabs 75 along one side thereof and apertures 77 along the other side thereof.

Figure 6:
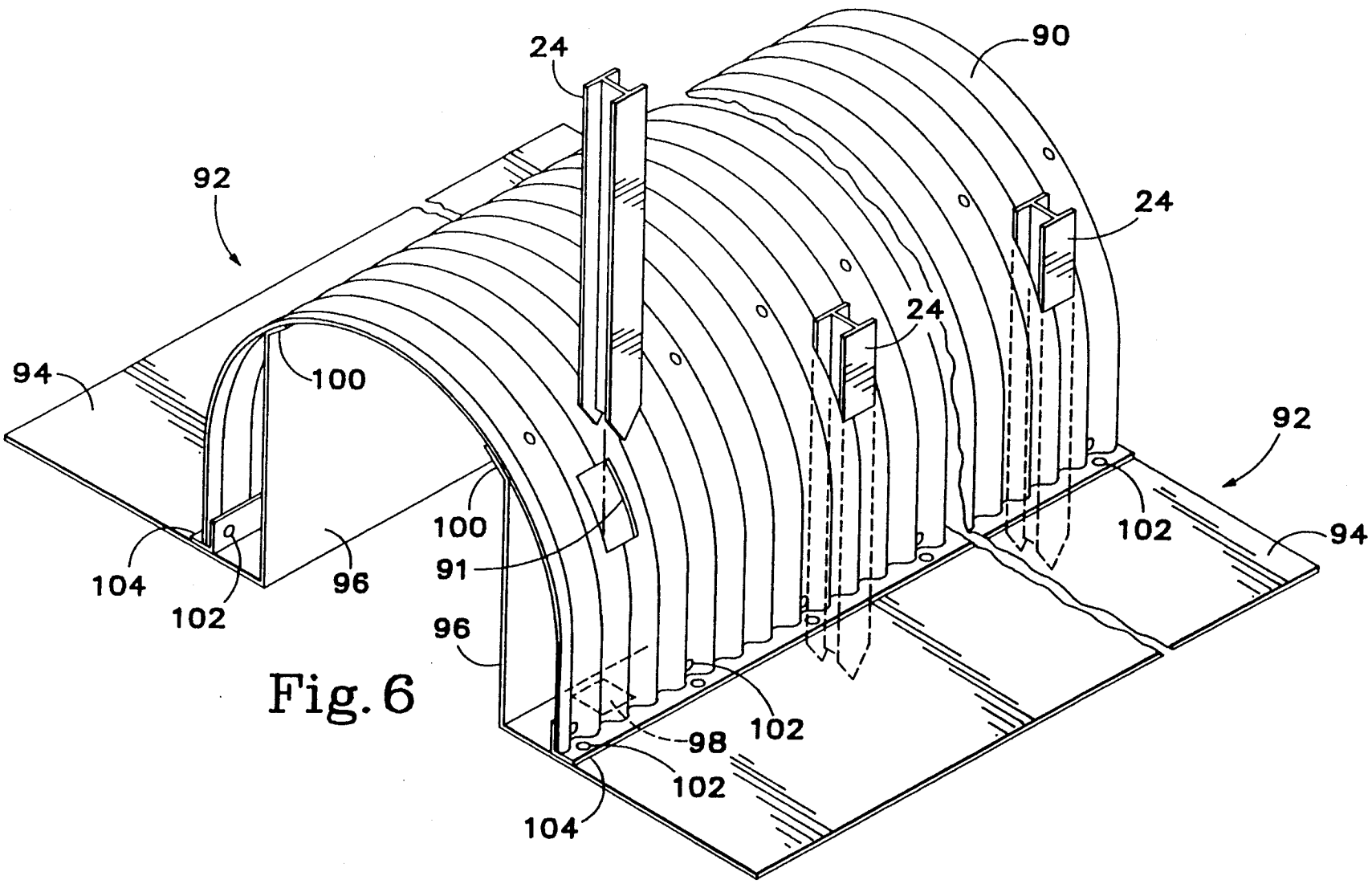
FIG. 6 is a perspective view of an alternative embodiment of a natural bottom culvert according to the present invention, including an arch structure affixed over L-shaped footings.

Turning now to FIG. 6, another alternative embodiment of a natural bottom culvert is shown. The culvert comprises an arch structure 90 and footings 92. The arch structure 90, like the arch structure 10 of FIG. 1, preferably is a standard pipe arch, that is, half of a metal pipe, which is corrugated and coated to resist deterioration. The arch structure 90, unlike the arch structure 10 of FIG. 1, has a plurality of guide holes 91 disposed along its length, preferably at regularly spaced intervals.

As with the footings 12 of FIG. 1, each footing 92 has a substantially L-shaped cross-section, a horizontally directed baseplate 94 and an upwardly-directed wall 96. Each baseplate 94, like the baseplates 14 of FIG. 1, is substantially planar and rectangular, and lies on a terraced portion of the bank of the stream to be crossed with the baseplate's long axis substantially co-directional with the stream. Each baseplate 94 has a plurality of apertures 98 disposed along the length of the baseplate 94 adjacent the wall 96, like the apertures 20 of footings 12 of FIG. 1. Unlike the footings 12 of FIG. 1, each footing 92 ordinarily has no tubular guides 18.

Each wall 96 is disposed on and substantially along the full length of, the stream-side edge of the baseplate 94. The walls 96 preferably are bent along their top edges to form platforms 100 for receiving and supporting the arch structure 90. The platforms 100 are at angles that correspond to the curvature of the arch structure 90.

The arch structure 90 preferably is affixed to the footings 92 by placing it over each wall 96 so that the underside of the arch structure 90 is seated on each platform 100 and the ends of the arch structure 90 are in linear contact with the baseplates 92. The arch structure 90 is then affixed to the footings 92 by either welding or bolting the arch structure 90 to each platform 100 and to each baseplate 94 at connection points 102 that preferably are spaced at substantially regular intervals along the length of the platforms 100 and the baseplates 94. Although the arch structure 90 may be welded directly to the baseplates 92, preferably each end of the arch structure 90 is affixed, by welding or bolting, to a piece of angle steel 104 that is substantially the same length as the arch structure 90, and the pieces of angle steel 104 are be affixed by welding or bolting, to the baseplates 94. In each case the welds or bolts are spaced at regular intervals along the length of the pieces of angle steel 104. It is to be recognized that other methods to affix the arch structure 90 to the footings 92 could be used without departing from the principles of the invention.

The apertures 98 are aligned with the guide holes 91 of the arch structure 90 so that a plurality of anchor posts 24 may be driven into the terrace through both the guide holes 91 and their corresponding apertures 98. Once installed, the anchor posts 24 are affixed to the arch structure 90 and to the footings 92 preferably by welding so that the footings 92 will remain in place should high-water conditions undermine the footings 92. Over this assembly of arch structure 90, footings 92 and posts 24, fill material is placed, on the surface of which a road is constructed.

Figure 7:
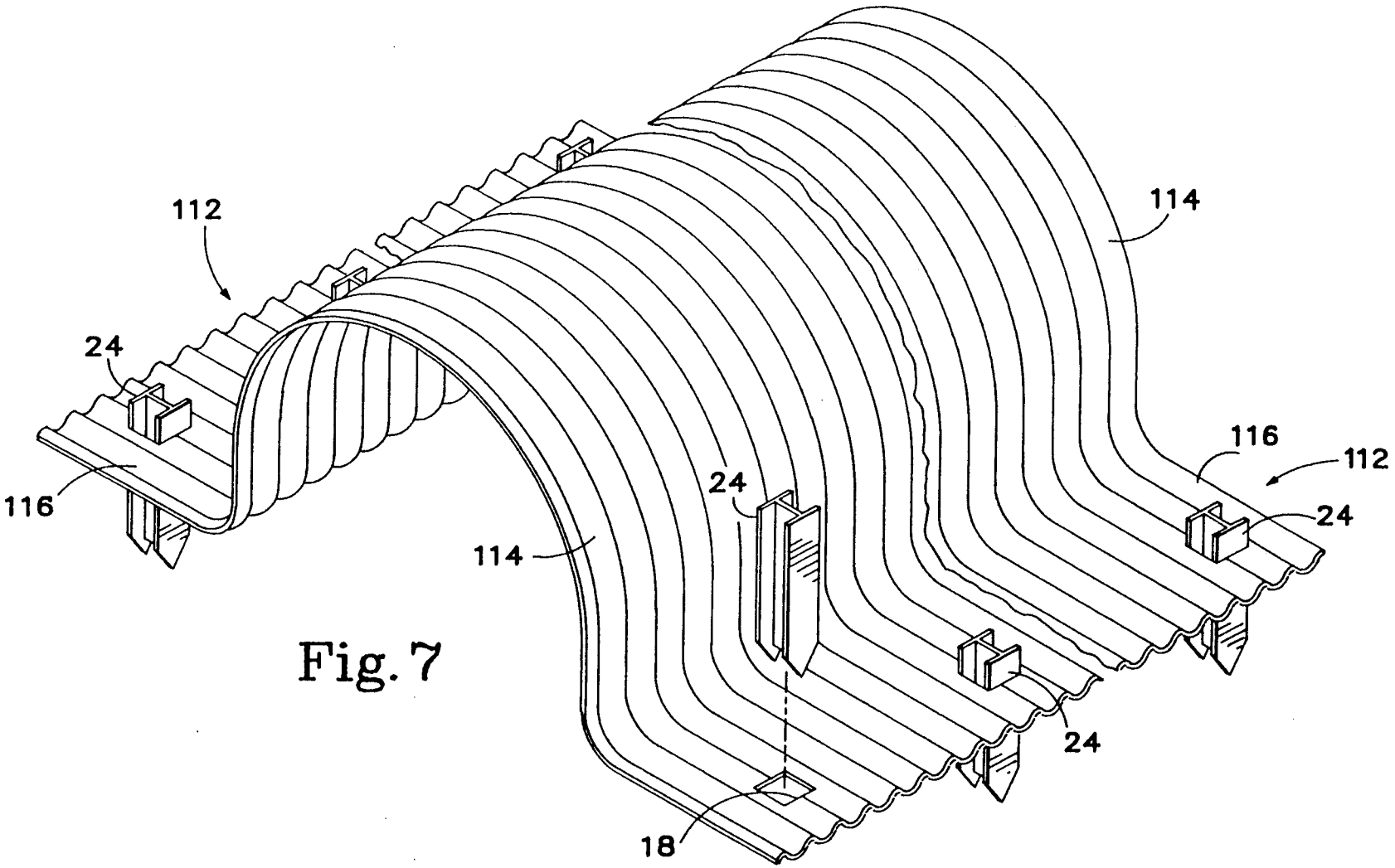
FIG. 7 is a perspective view of an alternative embodiment of a natural bottom culvert according to the present invention, including a metal plate bent to form an arch portion between and integral with two footing portions having anchor post apertures.

Referring to FIG. 7, yet another alternative embodiment of a natural bottom culvert comprises a single metal plate 112 bent to form an arch portion 114 between and integral with two footing portions 116. Each footing portion 116 has a plurality of apertures 118 disposed at substantially regular intervals along its length, disposed adjacent the edge of the footing portion 116 away from the stream. A plurality of anchor posts 24 are driven into the terrace through the apertures 118 and are affixed to the footing portions 116 by either welding or bolting, so that the structure will remain in place should high-water conditions undermine the culvert. Over this structure, fill material is placed, on the surface of which a road is constructed.

The natural bottom culverts of the present invention have dimensions that are determined by the application, including the high-water levels to be passed through the culvert. Dimensions generally increase with depth and elasticity of the fill material covering the culvert and with increased water volume. For example, as depth increases, the anchor posts 24 must be lengthened and the horizontal width of the footings 12, 50 and 92 and footing portions 116 must be increased. Although dimensions are not determined by formula, for the footings 12, 50 and 92, the vertical height is preferred to be at least two feet and the horizontal width of each footing is preferred to be at least six feet from the streamside edge to the opposite edge. The horizontal width of the footings 12, 50 and 92 preferably is selected so as to withstand high-water levels by resisting the rotation of fill material under the footings 12, 50 and 92, and keeping the fill material in place under heavy loads.

Referring to FIGS. 8(*a*)–(*c*), the method for installation of the natural bottom culvert according to the present invention is shown at various stages of progress. In FIG. 8(*a*), the stream, streambed and stream banks are shown prior to initiation of installation.

Each bank of the stream is prepared by terracing a strip of earth at a predetermined distance from the stream edges which preparation, preferably, is accomplished using earth moving equipment that reaches across the stream so as to avoid disturbing the streambed and any other injury to the in-stream environment. With the terraces prepared, footings 50 are placed thereon, again preferably using equipment that does not injure the in-stream environment. Since the stream bank is left undisturbed, except for the removal of some material to form the terraces, and is not replaced by a foundation, undermining is unlikely, the bank having achieved stability over a long period of time.

The footings 50 are held in place by anchor posts 24 positioned, in the case of the embodiment shown in FIGS. 8(*a*) and (*b*), through the apertures 53 of the beams 54 and the guides 60 of the baseplates 52. The anchor posts 24 can be driven with a pneumatic hammer mounted on an excavator or pushed into the terrace with the excavator's bucket. Preferably, twice as many anchor posts 24 are used when they are pushed in, than when they are driven in. FIG. 8(*b*) shows the installation of the natural bottom culvert at the stage where footings 50 have been installed on each terraced stream bank and anchor posts 24 have been driven into the terraces. In the event that water does wash out stream bank material beneath the footings, the anchor posts will hold the culvert in place long enough for that stream bank material to be replaced by concrete, rock or some other appropriate foundation material.

Once the footings have been installed and fixed in place by anchor posts, the arch structure is then attached to the footings. FIG. 8(*c*) shows the installation at the stage where composite arch 70 has been installed on the footings 50 using pieces of angle steel 82. Finally, over this structure, fill material is placed, on the surface of which the road is constructed.

The terms and expressions which have been employed in the foregoing specification are employed therein as terms of description and not of limitation, and there is no intention in the use of such terms and expressions of excluding equivalents of the features shown and described or portions thereof, it being recognized that the scope of the invention is defined and limited only by the claims which follow.

I claim:

1. A stream culvert, comprising:

(a) an elongate arch-shaped member for placement over a stream with its longitudinal dimension codirectional with the stream;

(b) at least one elongate footing disposed along and connected to said arch-shaped member at one side of said arch-shaped member, said footing comprising a baseplate having a substantially-planar portion disposed so as to lie adjacent the surface of a bank of the stream when said arch-shaped member is placed over the stream, said footing having a plurality of apertures disposed therethrough and spaced along the elongate dimension of said arch-shaped member; and (c) a plurality of elongate anchor posts adapted for placement through respective said apertures in said footing so that the respective longitudinal dimensions of said anchor posts are substantially perpendicular to said planar portion of said baseplate of said footing.

2. The culvert of claim 1, wherein said footing further comprises a vertical member affixed to said baseplate substantially along the full length of said arch-shaped member and a plurality of guides through said vertical member for receiving respective said anchor posts, said guides being aligned with said apertures in said footing.

3. The culvert of claim 2, wherein said arch-shaped member is separate from said footing and seated, at each edge thereof, on said footing in contact with said vertical member thereof, said arch-shaped member being affixed to said vertical member of said footing at a plurality of connection points spaced along the length of said arch-shaped member.

4. The culvert of claim 2, wherein said baseplate has an interior edge closest to the other side of said arch-shaped member, and said vertical member comprises a substantially planar, rectangular wall offset from said interior edge so as to form an elongate lip with a width equal to said offset, said guides of said footing comprising tubular guides affixed both to said wall and to said baseplate on the side of said wall opposite said interior edge.

5. The natural bottom culvert of claim 4, wherein said arch-shaped member comprises a pipe arch.

6. The natural bottom culvert of claim 5, wherein said pipe arch comprises corrugated metal with a corrugation depth substantially equal to said offset.

7. The culvert of claim 4, wherein said arch-shaped member comprises a pair of plates of arch-shaped cross section disposed at a substantially constant distance from each other, a core material disposed in the space between said plates, a first elongate beam of I-shaped cross-section disposed along one end of said pair of plates and said core material, the top and bottom members of said first I-shaped beam being disposed outside respective said plates, and a second elongate beam of I-shaped cross-section disposed along the other end of said pair of plates and said core material, the top and bottom members of said second I-shaped beam being disposed outside respective said plates.

8. The culvert of claim 7, further comprising a plurality of tension cables attached at substantially regular intervals to both said first I-shaped beam and to said second I-shaped beam, each of said cables being disposed through the lower of said pair of plates and said core material and under the bottom of the lower of said pair of plates so as to resist separation of said I-shaped beams.

9. The culvert of claim 7, wherein at least one said I-shaped beam is seated on said footing and affixed to said wall of said footing.

10. The culvert of claim 1, wherein said baseplate has an interior edge closest to the other side of said arch-shaped member, and said vertical member of said footing comprises an elongate beam with an H-shaped cross-section offset from said interior edge of said baseplate, said guides of said footing comprising a plurality of apertures in the cross-member of said beam.

11. The culvert of claim 10, wherein said arch-shaped member comprises a pipe arch seated, at each edge thereof, on said footing, one said edge being in contact with, and affixed to, the side of said H-shaped beam closest to said interior edge of said footing.

12. The culvert of claim 11, wherein said pipe arch comprises corrugated metal having a corrugation depth substantially equal to said offset.

13. The culvert of claim 10, wherein said arch-shaped member comprises a pair of plates of arch-shaped cross section disposed at a substantially constant distance from each other, a core material disposed in the space between said plates, a first elongate beam of I-shaped cross-section disposed along one end of said pair of plates and said core material, the top and bottom members of said first I-shaped beam being disposed outside respective said plates, and a second elongate beam of I-shaped cross-section disposed along the other end of said pair of plates and said core material, the top and bottom members of said second I-shaped beam being disposed outside respective said plates.

14. The culvert of claim 13, further comprising a plurality of tension cables attached at substantially regular intervals to both said first I-shaped beam and to said second I-shaped beam, each of said cables being disposed through the lower of said pair of plates and said core material and under the bottom of the lower of said pair of plates so as to resist separation of said I-shaped beams.

15. The culvert of claim 13, wherein at least one said I-shaped beam is seated on said footing and affixed to said wall of said footing.

16. The culvert of claim 1, wherein said baseplate is substantially planar and has an interior edge closest to the other side of said arch-shaped member, and said footing further comprises a vertical member affixed to said baseplate substantially along the full length of said interior edge, said plurality of apertures being formed through said baseplate and spaced along the length thereof, said arch-shaped member being disposed over said vertical member so that the underside surface of said arch-shaped member is in contact with the upper end of said vertical member and one edge of said arch-shaped member is in contact with said baseplate, said arch-shaped member being affixed to said vertical member and to said footing, said arch-shaped member having a plurality of apertures disposed therethrough corresponding to said apertures disposed through said baseplate for receiving said anchor posts.

17. The culvert of claim 16, wherein said vertical member of said footing comprises a substantially planar, rectangular wall having a top edge bent along the full length thereof to an angle that corresponds to the curvature of the underside surface of said arch-shaped member adjacent said top edge so that a surface of said top edge of said wall makes substantial contact with the underside surface of said arch-shaped member.

18. The culvert of claim 17, wherein said arch-shaped member comprises a pipe arch of corrugated metal.

19. The culvert of claim 1, wherein said arch-shaped member and said footing comprise a single, continuous plate having an elongate arch-shaped portion and a footing portion.

20. The culvert of claim 1, wherein said footing is disposed on a terraced bank of said stream and said anchor posts are disposed in respective said apertures disposed through said footing, driven into the ground beneath said footing and affixed to said footing.

21. A method for installing a natural bottom culvert over a stream that is to be crossed in constructing a road, comprising the steps of:

(a) preparing a terrace on at least one bank of the stream at a predetermined distance from the stream edge by using earth moving equipment that avoids any injury to the in-stream environment;

(b) placing a footing on said terrace using equipment that avoids any injury to the in-stream environment;

(c) fixing said footing in place by positioning at least one anchor post through said footing, driving said anchor post into the ground beneath said footing and affixing said anchor post to said footing; and (d) placing fill material over said footing.

22. The method of claim 21, further comprising the steps of attaching an arch-shaped member to said footing so as to span said stream, and placing fill material over said arch-shaped member.

23. The method of claim 21, wherein said bank of said stream is disposed on the opposite side of said earth moving equipment, further comprising the step of reaching across said stream with said earth moving equipment to prepare said terrace, and placing said footing thereon.

24. The method of claim 21, wherein step (c) further comprises positioning a plurality of anchor posts through said footing, driving said anchor posts into the ground beneath said footing and affixing said anchor posts to said footing.

* * * * *